US010058147B2

(12) United States Patent
Wernow et al.

(10) Patent No.: US 10,058,147 B2
(45) Date of Patent: Aug. 28, 2018

(54) ATHLETIC SHOE WITH AN ATTACHED MOVEABLE CLEAT

(71) Applicants: Sheldon Wernow, Ponte Vedra Beach, FL (US); Kathleen A. Tagle, Winter Park, FL (US); Robert Vaccaro, Ponte Vedra Beach, FL (US)

(72) Inventors: Sheldon Wernow, Ponte Vedra Beach, FL (US); Kathleen A. Tagle, Winter Park, FL (US); Robert Vaccaro, Ponte Vedra Beach, FL (US)

(73) Assignee: Safe Secure Sports, LLC, Ponte Vedra Beach, FL (US)

( * ) Notice: Subject to any disclaimer, the term of this patent is extended or adjusted under 35 U.S.C. 154(b) by 26 days.

(21) Appl. No.: 14/858,302

(22) Filed: Sep. 18, 2015

(65) Prior Publication Data

US 2016/0081434 A1 Mar. 24, 2016

Related U.S. Application Data

(60) Provisional application No. 62/052,056, filed on Sep. 18, 2014.

(51) Int. Cl.

| | |
|---|---|
| ***A43C 15/16*** | (2006.01) |
| ***A43B 5/02*** | (2006.01) |
| *A43B 5/00* | (2006.01) |

(52) U.S. Cl.

CPC ..... *A43C 15/161* (2013.01); *A43B 5/02* (2013.01); *A43C 15/16* (2013.01); *A43C 15/167* (2013.01); *A43C 15/168* (2013.01); *A43B 5/001* (2013.01)

(58) Field of Classification Search

CPC ..... A43B 5/02; A43B 5/001; A43C 15/161; A43C 15/167; A43C 15/16; A43C 15/168

USPC ..... 36/134

See application file for complete search history.

(56) References Cited

U.S. PATENT DOCUMENTS

| | | | | | |
|---|---|---|---|---|---|
| 1,025,087 | A * | 4/1912 | Hart | A43C 15/161 | 36/67 D |
| 1,361,078 | A * | 12/1920 | Lynn | A43C 15/14 | 135/81 |
| 3,496,656 | A * | 2/1970 | Caine | A43B 5/00 | 219/121.12 |
| 3,631,614 | A * | 1/1972 | Rice | A43C 15/14 | 36/61 |
| 3,882,614 | A * | 5/1975 | Albaladejo | A43C 15/161 | 36/67 D |
| 4,240,215 | A * | 12/1980 | Broussard | A43C 15/161 | 36/127 |
| 4,262,434 | A * | 4/1981 | Michelotti | A43B 13/26 | 36/129 |

(Continued)

*Primary Examiner* — Katharine Gracz

(74) *Attorney, Agent, or Firm* — Sand & Sebolt; Howard L. Wernow

(57) ABSTRACT

An athletic shoe including a moveably attached cleat is intended to displace relative to the sole on the shoe in certain situations. This allows the cleat to more easily disengage the turf than a convention fixed cleat. The moveably attached cleat allows the shoe to disengage from the turf when the wearer is subjected to side impact forces, thus reducing the likelihood of traumatic knee injuries for the wearer. However, when the wearer is running forward, there is a reaction force on the cleat from the turf, acting in the forward direction which does not cause the cleat to displace to the retracted position and it can remain in the extended position.

17 Claims, 5 Drawing Sheets

(56) References Cited

U.S. PATENT DOCUMENTS 4,492,047 A * 1/1985 Arff ..... A43C 15/161 36/134
4,873,774 A * 10/1989 Lafever ..... A43C 15/14 36/134
5,299,369 A 4/1994 Goldman
5,313,718 A 5/1994 McMahon et al.
5,351,422 A * 10/1994 Fitzgerald ..... A43B 5/001 36/134
5,377,431 A * 1/1995 Walker ..... A43C 15/168 36/134
5,456,027 A 10/1995 Tecchio et al.
5,497,565 A 3/1996 Balgin
5,617,653 A * 4/1997 Walker ..... A43B 13/26 36/128
5,732,482 A * 3/1998 Remington ..... A43C 15/168 36/127
5,740,619 A 4/1998 Broder
5,743,029 A * 4/1998 Walker ..... A43B 13/26 36/114
6,125,556 A 10/2000 Peckler et al.
6,182,381 B1 2/2001 Kancko et al.
6,481,122 B2 * 11/2002 Brahler ..... A43C 15/165 36/127
6,739,075 B2 * 5/2004 Sizemore ..... A43B 13/182 36/61
6,808,462 B2 10/2004 Snyder et al.
7,194,826 B2 * 3/2007 Ungari ..... A43B 5/02 36/128
7,310,895 B2 12/2007 Whittlesey et al.
8,079,160 B2 * 12/2011 Baucom ..... A41D 13/065 36/61
8,215,034 B2 7/2012 Krouse
8,256,145 B2 * 9/2012 Baucom ..... A43B 1/0018 36/61
8,347,527 B2 1/2013 Thielen
8,453,349 B2 * 6/2013 Auger ..... A43C 15/162 36/59 R
2002/0026731 A1 * 3/2002 Brahler ..... A43C 15/161 36/134
2007/0251128 A1 * 11/2007 Yen ..... A43C 15/161 36/134
2008/0066348 A1 3/2008 O'Brien et al.
2010/0199525 A1 8/2010 Thielen
2011/0005103 A1 1/2011 Krouse
2014/0310995 A1 * 10/2014 Campari ..... A43C 15/161 36/134
2015/0351493 A1 * 12/2015 Ashcroft ..... A43B 5/02 36/132
2016/0021981 A1 * 1/2016 Sanchez ..... A43B 5/00 36/134

* cited by examiner

ATHLETIC SHOE WITH AN ATTACHED MOVEABLE CLEAT

CROSS REFERENCE TO RELATED APPLICATION

This application claims the benefit of U.S. Provisional Patent Application Ser. No. 62/052,056, filed on Sep. 18, 2014; the disclosure of which is entirely incorporated herein by reference.

BACKGROUND

Technical Field The present disclosure relates generally to the field of athletic gear. More particularly, the present disclosure relates to an improved shoe device including safety features. Specifically, the present disclosure relates to cleats on a shoe configured to move between an extended or fixed position and a collapsed position to prevent knee injuries when the wearer is subjected to side impact forces.

Background Information

Dynamic mechanical systems often include two or more elongated members pivotably connected to each other by a pivot joint. The pivot joint allows the two elongated members to operatively move in a pivoting manner relative to each other. More complex dynamic systems may include three elongated members connected end-to-end by a first pivot joint and a second pivot joint. The two pivot joints permit relative movement of the three elongated members relative to one another.

With continued reference to a three member dynamic system connected by two pivot joints, it is well understood that if one of the pivot joints becomes non-pivotable, or fixed, then the amount of pressure imparted to the remaining pivot joint increases.

One example of a dynamic system that includes three members connected by two pivoting joints is the lower extremity anatomy of the human body. More particularly, the foot is a first member connected to the lower leg at the pivotable ankle joint. The lower leg is connected to the upper leg at the pivotable knee joint.

In sports, players often believe that they need to secure their ankle joint with stiff athletic tape for increased stability on the playing field. In American Football, this is a technique known as "spatting." When a player spats their ankle, they tightly wrap athletic tape over their pair of athletic footwear locking the ankle joint in a substantially non-movable position.

Recently, many sports have been making great strides to improve playing conditions that improve the safety of the game to reduce the number of serious injuries suffered by its players. One such organization making great strides in this area is the National Football League ("NFL") with its headquarters at 345 Park Avenue, Midtown Manhattan, New York City, USA. Another exemplary organization making great strides to reduce injuries for football players is the National Collegiate Athletic Association ("NCAA") with its headquarters in Indianapolis, Ind.

SUMMARY

Issues continue to exist with conventionally known athletic shoes having cleats affixed thereto, even though cleats have been part of sports shoes for decades. Usually in the shape of truncated cones, cleats are fixed, raised areas of the shoe sole that engage in turf and increase traction for the wearer.

One disadvantage of conventional cleat design is that in some cases when the wearer gets hit by another player, the cleats of the wearer's shoe are locked in the turf, immobilizing the foot, and the stress of the impact is transferred to another joint in the mechanical link, such as the knee. In some cases knee injuries can be attributed to this phenomenon.

One of the inventors, Dr. Sheldon F. Wernow of Ponte Vedra Beach, Fla., USA, has identified that knee injuries in professional football (as well as other sports such as soccer or lacrosse or baseball) may be reduced by adding another pivot point to the mechanical linkage of an athlete's body. Additionally, professional sports organizations, such as the NFL or NCAA, should require a new type of cleat design to be worn in their league in order to reduce their liability to former players if they know that knee injuries are more likely to occur with a conventional (non-moveable) cleat is worn by a player. The present disclosure addresses these and other issues.

In one aspect, an embodiment of the present disclosure may provide an athletic shoe including a cleat design that is intended to disengage or release itself from the turf in certain situations and remain attached to the turf in other situations. A cleat design is envisioned that is not fixed, but can move in certain conditions to allow it to disengage from the turf. A distinction is made regarding the direction of the applied forces on the cleat. For example, when the wearer is running forward, there is a reaction force on the cleat from the turf, acting in the forward direction.

In another aspect, an embodiment of the present disclosure may provide an improved athletic shoe comprising a cleat extending downwardly from a downwardly facing sole, wherein the cleat is displaceable between an extended position and a collapsed position, and wherein the cleat is moved to the collapsed position after subjection to a side impact force generally along a transverse axis yet remains in the extended position when subjected to a force along a longitudinal axis.

In another aspect, an embodiment of the present disclosure may provide an athletic shoe comprising: a sole having spaced front and rear ends defining a longitudinal axis therebetween and spaced left and right sides defining a transverse axis therebetween; a cleat moveable relative to the sole, wherein the cleat is displaceable between a first position extending beyond the sole and a second position generally flush with the sole. This embodiment may be, in combination with an ankle locking member configured to lock an ankle of an athlete when the shoe is worn, wherein the combination is adapted to reduce knee injuries of athlete when the athlete is subjected to force above the ankle and below the knee. Additionally, this embodiment may further comprise a bottom end on the cleat; and an arcuate path of travel for the bottom end of the cleat as the cleat moves from the first position to the second position. This embodiment may include a bottom end on the cleat; and a linear path of travel for the bottom end of the cleat as the cleat moves from the first position to the second position. This embodiment may include a coefficient of friction associated with the shoe relative to a ground surface with the cleat in the first position greater than the coefficient of friction with the cleat in the second position. Further, this embodiment may include wherein the cleat pivots about the longitudinal axis to move along a transverse plane, or wherein the cleat pivots about the transverse axis to move along a longitudinal plane. The cleat may move from the first position to the second position after subjection to an impact force.

Additionally in this embodiment, the cleat may include a top end spaced apart from a bottom end defining a vertical axis therebetween, the top end adjacent the sole and the bottom end exterior the sole in the first position and the bottom end adjacent the sole in the second position. the cleat may define a vertically aligned bore and a bias member adjacent the bore; wherein the bias member is a compression coil spring in the bore. This embodiment may include a set screw tensioning the spring to an optimized compression force. And, may further comprise a ball lock containing the bias member adjacent one end of the bore.

In this embodiment, the athletic shoe may include a cleat housing set within the sole; wherein the cleat housing is fixed relative to the sole allowing the cleat to move therein. Additionally, an upwardly tapered sidewall on the cleat housing extending from an aperture edge upwardly to a connection point.

In another aspect, an embodiment of the present disclosure may provide a method comprising the steps of: donning an athletic shoe having a cleat moveable between an extended first position and a collapsed second position generally flush with a sole of the shoe; moving in a first direction in a walking or running motion; subjecting the shoe to an external force; effecting the movement of the cleat from the first position to the second position if the external force exceeds a set threshold level. The threshold level may be determined by the step of: setting a bias member to an optimized level to allow the cleat to move from the first position to the second position.

BRIEF DESCRIPTION OF THE SEVERAL VIEWS OF THE DRAWINGS

A sample embodiment of the present disclosure is set forth in the following description, is shown in the drawings and is particularly and distinctly pointed out and set forth in the appended claims. The accompanying drawings, which are incorporated in and constitute a part of the specification, illustrate various example methods, and other example embodiments of various aspects of the present disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
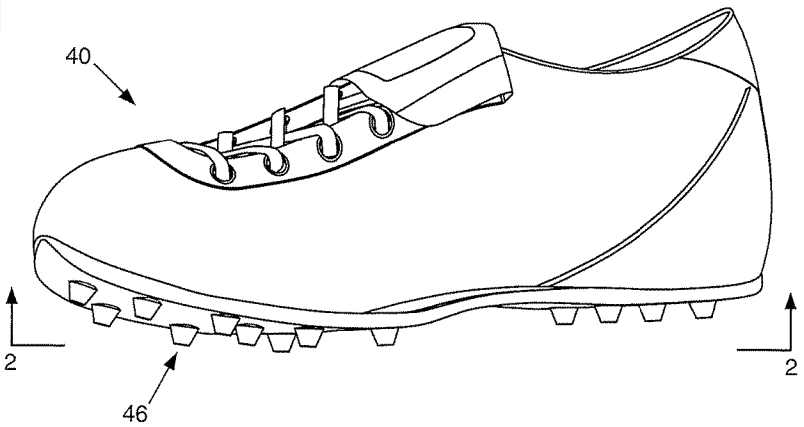
FIG. 1 is a side elevation view depicting a shoe having a plurality of moveably attached cleats extending generally downward from the sole.

As depicted in throughout the Figures, an embodiment of an improved athletic shoe is generally indicated at 40. Athletic shoe 40 includes a shoe sole 42, a downwardly facing ground engaging bottom surface 44, and a ball cleat member 46. Shoe 40 includes a left side 70 (when viewed from above) spaced opposite a right side 72 (when viewed from above) defining a transverse axis therebetween and a forward end 74 spaced opposite a rear end 76 defining a longitudinal axis therebetween.

Figure 2:
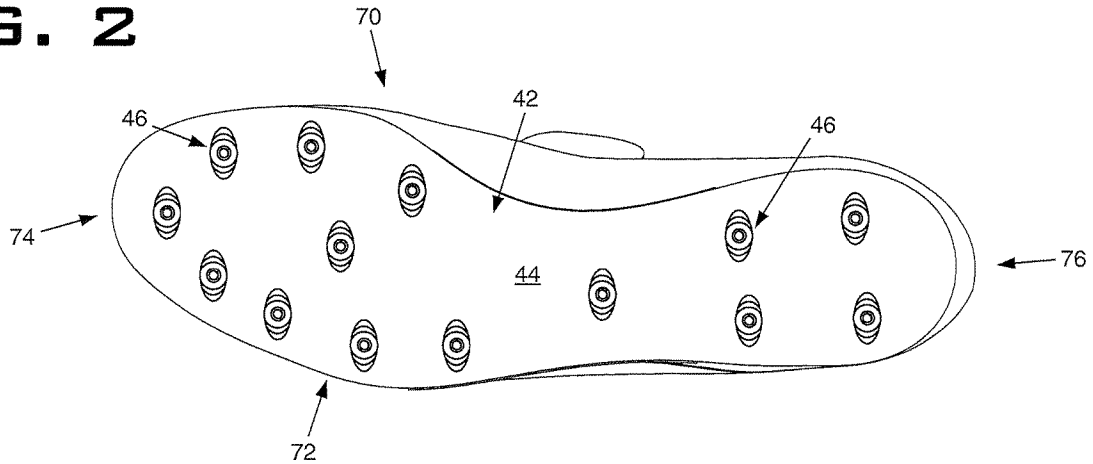
FIG. 2 is a bottom plan view taken along view line 2-2 in FIG. 1 depicting the layout arrangement of the plurality of moveably attached cleats.

As depicted in FIG. 2, a plurality of cleat members 46 are depicted arranged in a configuration along bottom surface 44 of sole 42. Cleat members 46 have a generally oval profile aligned with the transverse axis extending between left side 70 and right side 72, the purpose of which will be disclosed in greater detail below.

Figure 3:
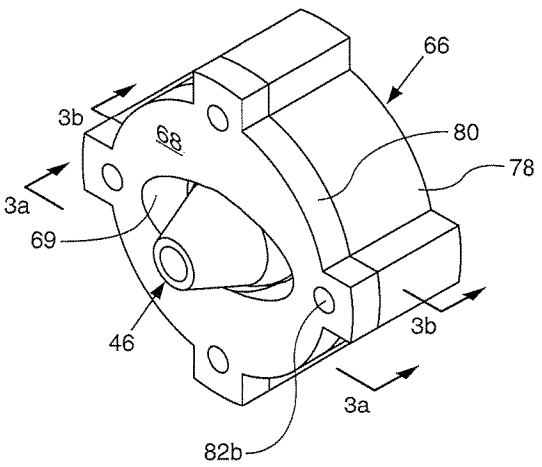
FIG. 3 is an isometric view of one of the moveable cleats in a housing.

As depicted in FIG. 3, each one of the plurality of cleat members 46 may be retained in a housing 66 including a first surface defining an upwardly tapered oval aperture 69. Housing 66 includes a first member 78 adjoining a second member 80 aligned together with corresponding bores 82A and 82B configured to receive a mounting member such as a screw therethrough. First member 78 is embedded within sole 42 of shoe 40. Second member 80 may lie flush with bottom surface 44 or may alternatively lie just above bottom surface 44 such that bottom surface 44 visually covers member 80 when viewed from the bottom.

Figure 3A:
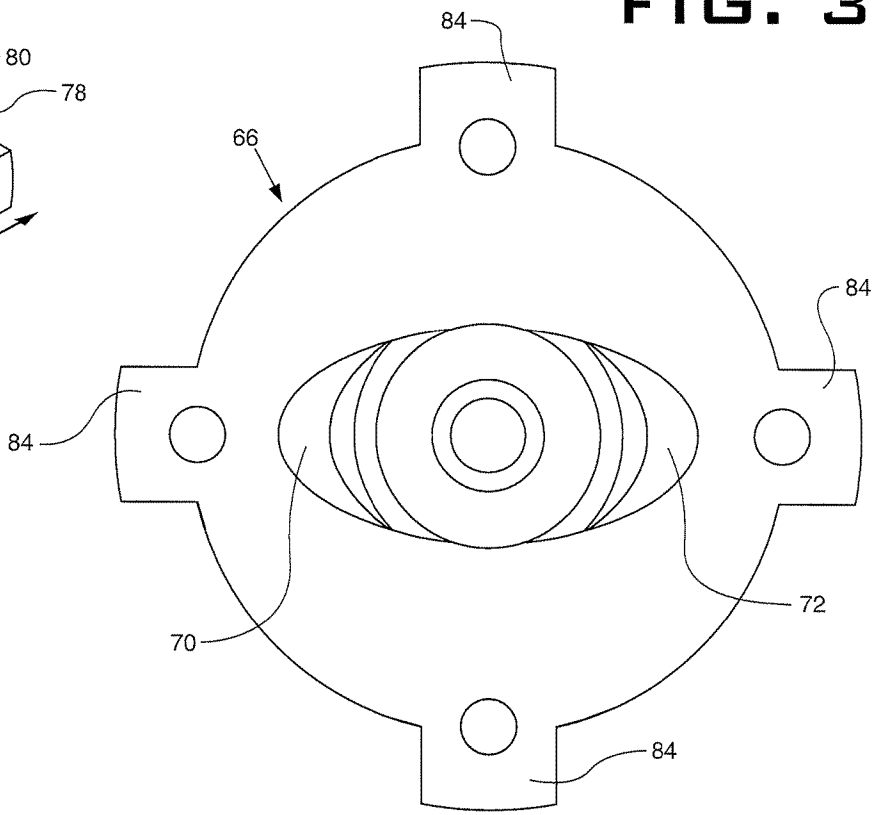
FIG. 3A is an enlarged bottom view of one of the cleats taken along line 3A-3A in FIG. 3.
Figure 3B:
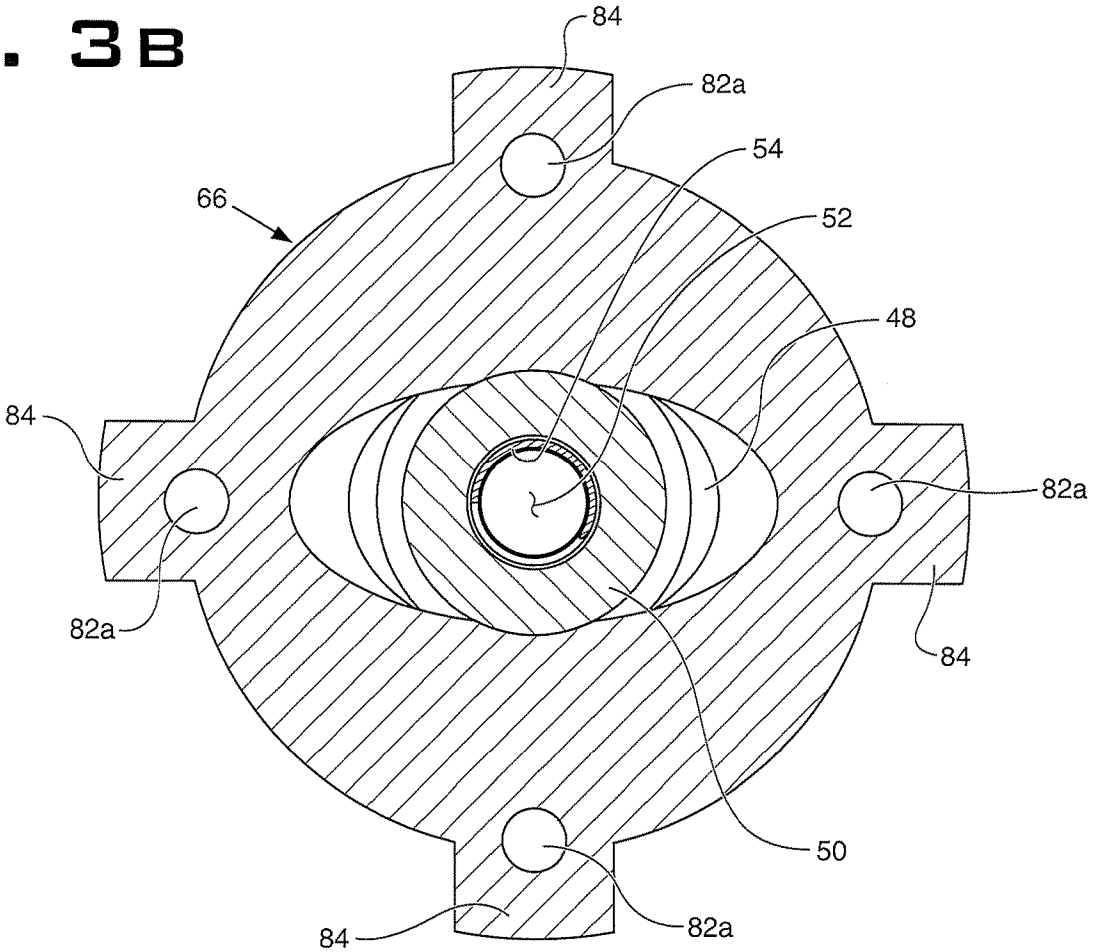
FIG. 3B is an enlarged cross section of one of the cleats taken along line 3B-3B in FIG. 3.

As depicted in FIG. 3A, housing 66 may have a generally circular profile and include symmetrically outwardly extending legs 84. Legs 84 offer stability for housing 66 carrying cleat member 46 when installed on shoe 40.

Figures 4, 4A:
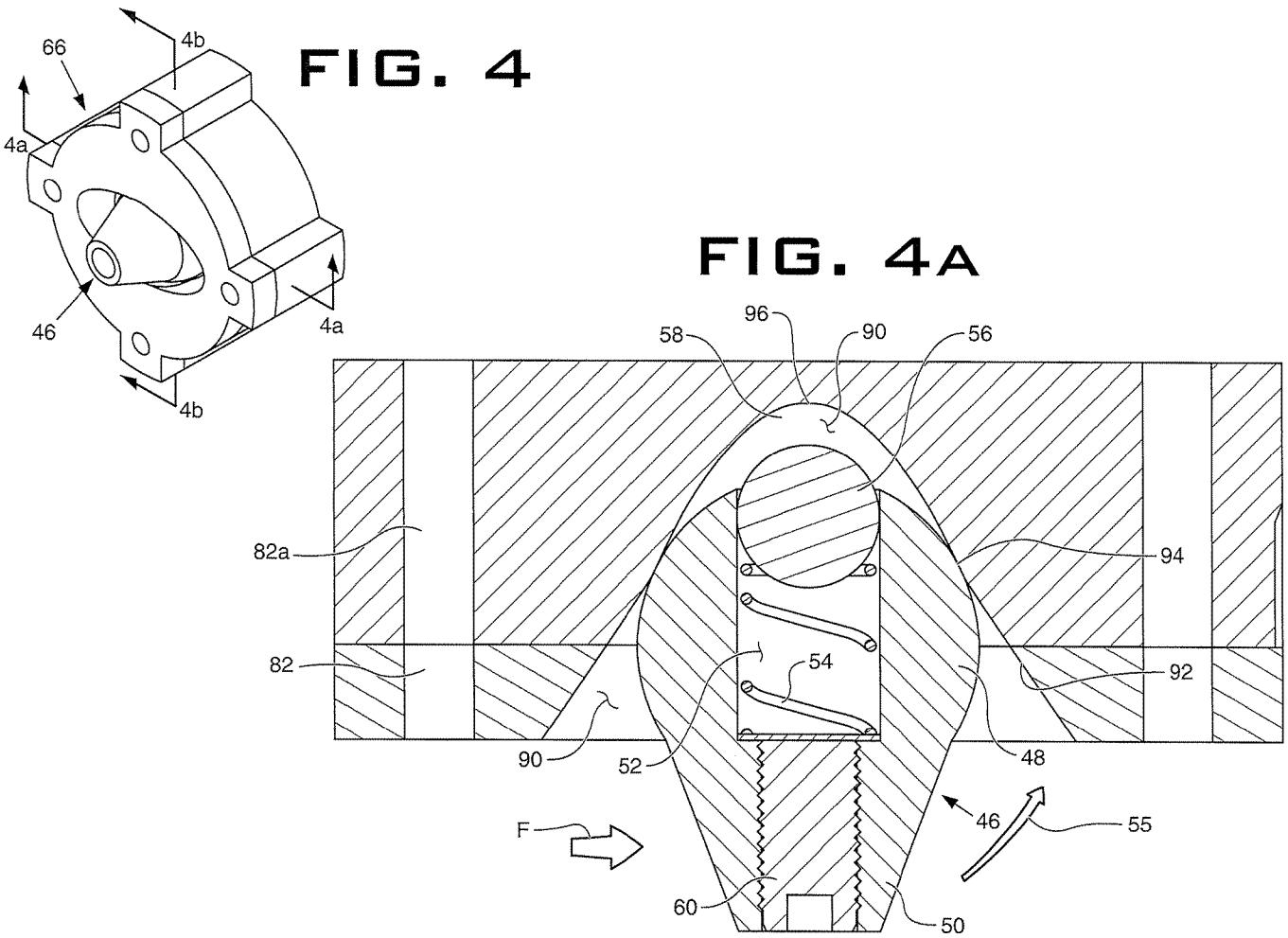
FIG. 4 is an isometric view of one of the moveable cleats similar to FIG. 3.
FIG. 4A is an enlarged cross section of one of the cleats taken along line 4A-4A in FIG. 4.
Figure 4B:
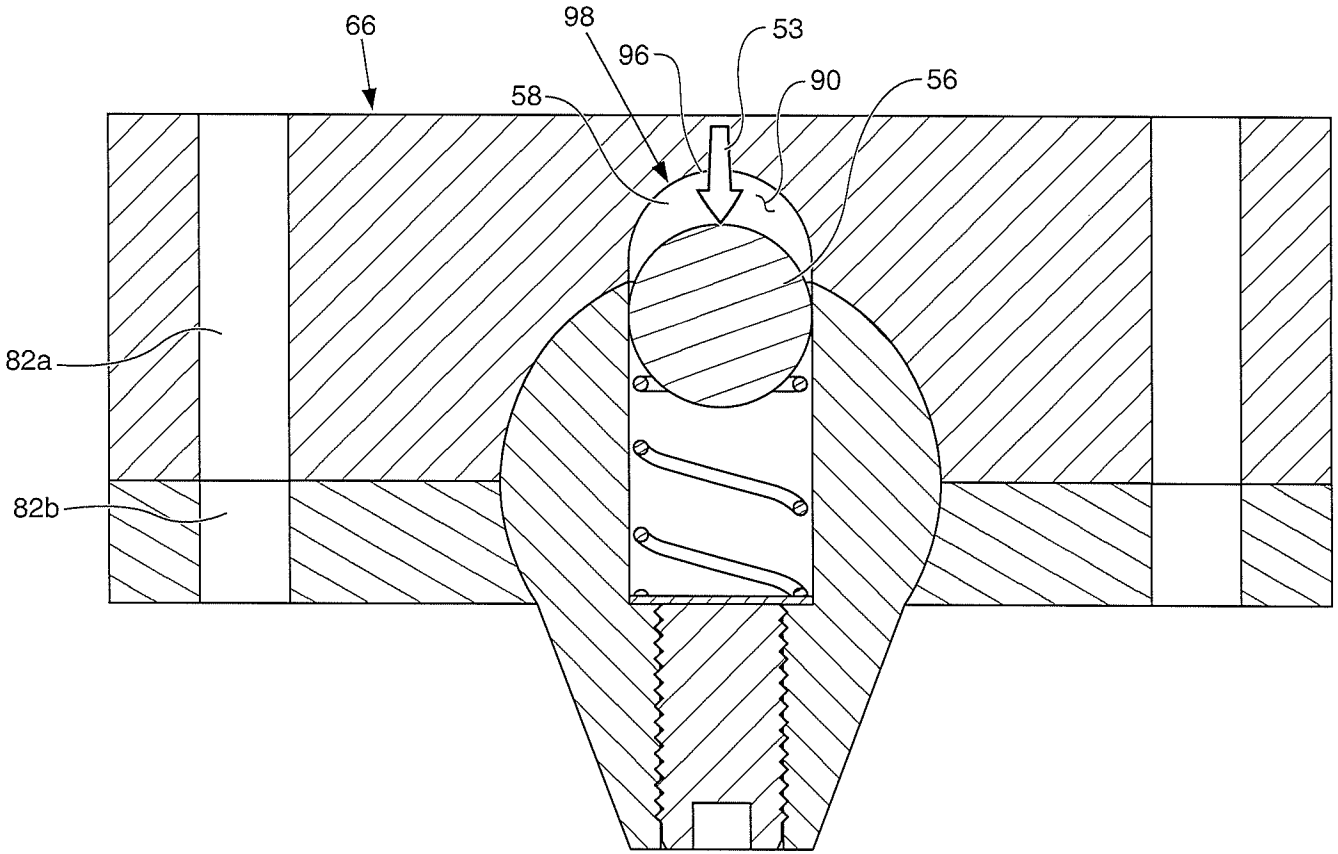
FIG. 4B is an enlarged cross section of one of the cleats taken along line 4B-4B in FIG. 4.

As depicted in FIG. 4A and FIG. 4B, housing 66 defines a cavity 90. More particularly, cavity 90 is defined by an upwardly tapered sidewall 92 extending from the oval edge defining oval aperture 69 upwardly toward a connection point 94. A portion of the sidewall continues upwardly from connection point 94 up towards an apex 96 having a slope that is parabolic in transverse cross section and steeper than that of sidewall 92. A seat area 58 is generally defined between point 94 and apex 96 within cavity 90 and will be described in greater detail below. Turning back to sidewall 92, it is generally planar in transverse cross section.

As depicted in FIG. 4B, seat portion 58 of cavity 90 in longitudinal cross section has a radius of curvature 98 complimentary to that of ball lock 56, the purpose of which will be described in greater detail below.

Cleat member 46 includes a generally spherical member 48 including a frustoconical bottom end 50. Sphere member 48 defines a generally cylindrical chamber 52 retaining a compression spring 54 therein. A ball lock 56 rests against the top of the spring 54 near the top of the cylindrical chamber 52 nestingly received in the seat 58. A set screw 60 may be operatively coupled to the bottom end of compression spring 54 through frustoconical bottom end 50 to set a desired compressive force to spring 54.

In operation, as shown in FIG. 4A and FIG. 4B, when shoe 40 is subjected to a side impact force (Arrow F), ball lock 56 compresses spring 54 downwardly such that ball 56 is forcibly removed from seat 58. Ball 56 moves downwardly in the direction of arrow 53 into chamber 52. Cleat 46 rotates, here depicted as a counter-clockwise direction in a path defined by arrow 55, allowing cleat 46 to disengage the ground surface. Shoe 40 provides an injury reducing shoe that can purposely give way when subjected to certain impact forces. Cleat 46 will not break away when subjected to normal forward forces such as when an athlete wearing shoe 40 is running forward, but in the event they are impacted from the side, cleat rotates to purposely disengage the ground surface.

In accordance with the present disclosure, improved athletic shoe 40 provides a moveable or displaceable cleat 46 that is designed to decrease its profile height when subjected to left or right side impact forces thus improving the ability for the cleat to disengage the ground surface. Generally, the cleat does not reduce its profile height by urging forces via spring 54 when subjected to normal forward forces such as when the player is running straight. However, it is possible to design the cleat to move in this manner. When cleat member 16 is in the collapsed position, cleat disengages ground surface easier than a conventional fixed cleat, allowing shoe 40 to purposefully slip away from the ground. This allows an athlete wearing shoe 40 to be less likely to suffer a knee injury when hit from the side, amongst other things, because the shoe 40 is more likely to disengage the ground surface than a conventional shoe with a fixed cleat or even a removably fixed cleat as is common in a conventional athletic shoe.

In accordance with an aspect of one embodiment of the present disclosure, improved shoe 40 having cleat 46 with ball lock 56 allows for a cleat integrally formed with insole 42 of shoe 40 to rotate about an axis such that cleat 46 breaks away and is displaceable when subjected to certain left to right side impact forces but remains fixed when subjected to forward forces such as when the athlete is running forward. The advantage of this is that an athlete wearing this improved device 40, it is believed, would be less likely to suffer knee injuries normally occurring when a shoe is affixed to a turf surface via a cleat.

Additionally, shoe 40 is based on a rocking design, operatively coupled to the pre-loaded spring. The main body of the cleat is spherical, and rides in a spherical recess formed into the sole of the shoe. Normal side forces are insufficient to compress the spring and the cleat remains fixed. When loading becomes excessive, such as a side impact from another player, the side force (Arrow F) on the cleat tends to rotate the cleat by compressing the spring, causing the cleat to retract.

A further aspect of the spherical seat 58 is that it can have different heights for the ball to overcome before motion occurs. The side that requires more deflection of the ball before motion occurs will require higher force on the cleat to cause retraction. For example, the force from the left to cause retraction can be different from the force from the right to cause retraction.

Additionally, athletic shoe designs may be based on telescoping design with a pre-loaded spring. The spring has sufficient pre-load such that no motion occurs under normal loading in the forward direction. With normal loading the cleat performs much like a conventional, fixed cleat. When loading becomes excessive, such as a side impact from another player, the force on the spring exceeds the pre-load, and the spring deflects, causing the cleat to retract. The angle on the cleat determines how much of the side load is transferred into an axial load to compress the spring. Note that the angle on the cleat can be varied, potentially on different sides of the same cleat, for different performance in an inside-hit or outside-hit scenario.

The intent is that the alternative telescoping cleat will retract, or displace upwardly at the moment of impact, and the displacement, although limited, will allow it to disengage from the turf. Another feature of this alternative embodiment is adjustability. A preload on a spring can be adjusted by rotating the cleat. An indication of rotation can be provided by an arrow on the outside of the cleat. Other adjustment mechanisms will be clear to those skilled in the art.

While the aforementioned embodiments are described with reference to a side impact force for moveably urging the cleat, it should be understood that the present disclosure equally applies to a forward force or a front side force as well as a rear side force that could just as likely result in knee injuries. To combat the front side force, the springs may be set at a desired pressure in PSI that allows the wearer to run forward and remain in place, yet if they are hit from the front, the cleats will retract or roll as described in the two embodiments.

Shoe 40 is configured to be used in combination with an ankle locking member configured to lock an ankle of an athlete when the shoe is worn. The particular ankle locking member is athletic tape wrapped in a spat or spatting technique which is commonly known in the art. Other exemplary ankle locking members are ankle braces that semi-lock the ankle. The combination of shoe 40 and ankle spatting or ankle brace is adapted to reduce knee injuries of athlete when the athlete is subjected to force above the ankle and below the knee.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the example embodiment of the present disclosure are an example and the present disclosure is not limited to the exact details shown or described.

What is claimed:

1. An athletic shoe comprising:

a sole having spaced front and rear ends defining a longitudinal axis therebetween and spaced left and right sides defining a transverse axis therebetween;

a plurality of housings connected to the sole, each housing defining a cavity;

a plurality of cleats, wherein one cleat from the plurality of cleats is positioned at least partially within the cavity of one housing from the plurality of housings, and at least one cleat is moveable relative to the sole, wherein the at least one cleat is displaceable between an extended first position extending beyond the sole in contact with a ground surface and a collapsed second position, wherein the collapsed second position is after the extended first position, and wherein the housing enables the cleat to displace from the extended first position to the collapsed second position in response to a force along the transverse axis, wherein the cleat moves about the longitudinal axis to move along a transverse plane;

wherein the housing causes the cleat to remain in the first position and not displace to the collapsed second position when the cleat is subjected to a force only along the longitudinal axis and the cleat does not pivot about the transverse axis and does not move along a longitudinal plane;

wherein when the athletic shoe is worn and the cleat engages the ground surface and is subjected to the force along the transverse axis from the left side, the cleat displaces to the collapsed second position such that the athletic shoe slips away from the ground surface; and wherein when the athletic shoe is worn and the cleat engages the ground surface and is subjected to the force along the transverse axis from the right side, the cleat displaces to the collapsed second position such that the athletic shoe slips away from the ground surface.

2. The athletic shoe of claim 1, further comprising:

a bottom end of a frustoconical wall on the at least one cleat that is vertically below the sole in the extended first position prior to subjection to the force along the transverse axis; and an arcuate path along a transverse plane of travel for the bottom end of the at least one cleat as the cleat transversely moves from the first position to the second position.

3. The athletic shoe of claim 1, further comprising:

a bottom end of a frustoconical wall on the at least one cleat that is vertically below the sole in the extended first position prior to subjection to the force along the transverse axis; and a linear path of travel for the bottom end of the at least one cleat as the cleat moves from the first position to the second position.

4. The athletic shoe of claim 1, further comprising:

a first coefficient of friction associated with the shoe relative to the ground surface with the at least one cleat in the extended first position that is greater than a second coefficient of friction with the at least one cleat in the collapsed second position, wherein the at least one cleat is collapsed after subjection to the force along the transverse axis.

5. The athletic shoe of claim 1, wherein the at least one cleat moves in a direction parallel to the transverse axis from the first position to the second position after subjection to an external impact force.

6. The athletic shoe of claim 5, wherein the at least one cleat includes:

a top end spaced apart from a bottom end of the at least one cleat defining a vertical axis therebetween, the top end is within the housing adjacent the sole and is spherical in shape, and the bottom end is frustoconical in shape and is exterior the sole in the extended first position and the bottom end is adjacent the sole in the collapsed second position.

7. The athletic shoe of claim 6, wherein the top end of the at least one cleat defines a vertically aligned cylindrical chamber therein and a bias member adjacent the cylindrical chamber.

8. The athletic shoe of claim 7, wherein the bias member is a compression coil spring inside the cylindrical chamber within the top end of the at least one cleat.

9. The athletic shoe of claim 8, further comprising:

a set screw coaxial with the compression coil spring inside the cylindrical chamber and tensioning the spring to an optimized compression force to permit the at least one cleat to displace from the extended first position to the collapsed second position.

10. The athletic shoe of claim 7, further comprising:

a vertically displaceable ball lock within the housing operatively coupled to the bias member adjacent the top end of the cylindrical chamber.

11. The athletic shoe of claim 1, wherein the cleat housing is shaped to permit cleat displacement along the transverse axis and preclude cleat displacement along the longitudinal axis.

12. The athletic shoe of claim 11, further comprising:

wherein an upwardly tapered sidewall on the cleat housing extends from an aperture edge upwardly to a connection point at a first slope and continuing to extend upwardly to an apex from the connection point at a different and steeper second slope.

13. The athletic shoe of claim 12, wherein the aperture is oval shaped.

14. The athletic shoe of claim 12, further comprising:

a ball seat defined between the connection point and the apex; and a ball lock on the at least one cleat lockingly received by the ball seat, the ball lock in a locked position when the cleat is in the first position and the cleat is in an unlocked position when the at least one cleat is in the second position.

15. A method comprising the steps of:

donning an athletic shoe defining an transverse axis between left and right sides of the shoe and the shoe having a plurality of cleats moveable between an extended first position and a collapsed second position;

moving in a first direction in a walking or running motion;

subjecting the shoe to an external force at least partially along the transverse axis;

effecting transverse movement of at least one cleat from the extended first position to the collapsed second position when the external force exceeds a set threshold level to encourage the athletic shoe to lose traction with a ground surface, wherein a housing is shaped to permit cleat displacement along the transverse axis; and wherein the housing is shaped to preclude cleat displacement when the cleat is subjected to a force only along a longitudinal axis; and wherein when the athletic shoe is worn and the cleat engages the ground surface and is subjected to the force along the transverse axis from the left side, the cleat displaces to the collapsed second position such that the athletic shoe slips away from the ground surface;

wherein when the athletic shoe is worn and the cleat engages the ground surface and is subjected to the force along the transverse axis from the right side, the cleat displaces to the collapsed second position such that the athletic shoe slips away from the ground surface.

16. The method of claim 15, wherein the threshold level is determined by the steps of:

setting a bias member to an optimized level to allow the at least one cleat to move transversely from the first position to the second position.

17. An athletic shoe comprising:

a sole having spaced front and rear ends defining a longitudinal axis therebetween and spaced left and right sides defining a transverse axis therebetween;

a housing connected to the sole, the housing including an upwardly tapered sidewall defining a cavity and a seat above the upwardly tapered sidewall;

a cleat positioned at least partially within the cavity of the housing and moveable relative to the sole, wherein the cleat is displaceable between an extended first position extending beyond the sole in contact with a ground surface and a collapsed second position, wherein the collapsed second position is after the extended first position, and wherein the housing enables the cleat to displace from the extended first position to the collapsed second position in response to a force along the transverse axis, wherein the upwardly tapered sidewall contacts the cleat in the collapsed second position, and the cleat including a spherical member disposed within the cavity of the housing and a frustoconical bottom end disposed at least partially outside the cavity of the housing;

a compression spring disposed in a cylindrical chamber defined by the spherical member;

a ball lock resting against a top of the compression spring near a top end of the cylindrical chamber nestingly received in the seat defined by the housing above the upwardly tapered sidewall;

a set screw operatively coupled to a bottom end of compression spring and extending through the frustoconical bottom end adapted to set a desired compressive force to spring; and wherein the housing causes the cleat to remain in the first position and not displace to the collapsed second position when the cleat is subjected to a force only along the longitudinal axis.

* * * * *